US007093410B2

(12) United States Patent
van Drunen

(10) Patent No.: US 7,093,410 B2
(45) Date of Patent: Aug. 22, 2006

(54) METHOD OF CLOSING A FLEXIBLE PACKAGING, A DEVICE FOR THIS PURPOSE AND A CLOSED FLEXIBLE PACKAGING

(75) Inventor: Frank Emiel Leon van Drunen, Schijndel (NL)

(73) Assignee: Schutte Holding, B.V., (NL)

( * ) Notice: Subject to any disclaimer, the term of this patent is extended or adjusted under 35 U.S.C. 154(b) by 0 days.

(21) Appl. No.: 10/960,181

(22) Filed: Oct. 7, 2004

(65) Prior Publication Data

US 2005/0081488 A1 Apr. 21, 2005

(30) Foreign Application Priority Data

Oct. 9, 2003 (NL) ..... 1024491

(51) Int. Cl.
*B65B 51/04* (2006.01)

(52) U.S. Cl. ..... 53/417; 53/138.3; 24/30.5 S; 383/71

(58) Field of Classification Search ..... 53/417, 53/138.3; 383/70, 71; 24/30.5 S
See application file for complete search history.

(56) References Cited

U.S. PATENT DOCUMENTS 3,270,481 A 9/1966 Hans
3,780,488 A 12/1973 Herrell
4,783,886 A * 11/1988 Koppe ..... 24/30.5 S
5,286,110 A 2/1994 Benson et al.
5,485,711 A * 1/1996 Suzuki et al. ..... 53/138.4
5,495,645 A * 3/1996 Suzuki et al. ..... 24/30.5 S
6,098,370 A * 8/2000 Kobayashi et al. ..... 53/138.3
6,453,640 B1 * 9/2002 Hayashi ..... 53/138.3
6,591,460 B1 * 7/2003 Hoshino ..... 24/30.5 S

FOREIGN PATENT DOCUMENTS

EP A-1099635 5/2001
GB 1 010 440 A 11/1965

* cited by examiner

*Primary Examiner*—John Sipos
(74) *Attorney, Agent, or Firm*—Todd Deveau; Thomas, Kayden, Horstemeyer & Risley LLP

(57) ABSTRACT

The invention relates to a method of closing an access side of a flexible packaging using a planar closure (15) made of plastic, the closure (15) comprising a slot (20) delimited by limb parts (215) and extending between the circumference of the closure and an opening (10), said method comprising the step of introducing the access side of the flexible packaging into the opening (10) of the closure (15) and the method comprising a subsequent step in which the slot (20) is at least partially sealed by means of a seal (30), which connects the limb parts (215) to one another, without substantially deforming the closure.

15 Claims, 9 Drawing Sheets

METHOD OF CLOSING A FLEXIBLE PACKAGING, A DEVICE FOR THIS PURPOSE AND A CLOSED FLEXIBLE PACKAGING

CROSS-REFERENCE TO RELATED APPLICATION

This application claims priority to and the benefit of NL 1024491 dated Oct. 9, 2003.

BACKGROUND OF THE INVENTION

The invention relates to a method of closing an access side of a flexible packaging using a planar closure made of plastic, the closure comprising a receiving opening for receiving and retaining the access side of the flexible packaging, as well as a slot delimited by limb parts of the closure and extending between the circumference of the closure and the receiving opening, said method comprising the step of introducing the access side of the flexible packaging into the opening of the closure.

FIELD OF THE INVENTION

A method of this kind is generally known in the field of plastic closures, for example for the mechanically closing of bags filled with bakery products. In this case, the bags are compressed at their access side to form a neck and said neck is placed between brushes. Subsequently, the neck which is being held between the brushes is introduced via a conveying element into the opening of a planar closure. The planar closure is usually broken off a strip of interconnected closures by machine. In this way, it is possible mechanically to close a flexible packaging using planar closures.

However, the planar closures have the shortcoming that they can be opened without this being visible afterwards. As a result, a packaging which has been closed using a closure of this kind can be opened and its contents can be altered or damaged without this being detectable afterwards. Hence, when using packaging closed in this manner, a closure of this kind does not guarantee that the contents correspond with the original contents. Both with regard to the (distributive) trade and to the consumer, there is therefore a need for packaging closures which can give such a guarantee. This feature of a closure is known in the field by the term 'tamper-proof'. In addition, there is a need for a device for mechanically closing packaging which is able to fit such tamper-proof closures.

Attempts to fit such tamper-proof closures are known from the prior art. EP-A-1099635 discloses a device for closing bags using closures, in which, after the neck of the bag has been arranged in the receiving opening, the limb parts delimiting the access slot are bent one over the other and are connected to one another by means of hook portions provided in the vicinity of the free ends of the limb parts. Subsequently, a dowel is provided as pressure connection in the now overlapping sections of the limb parts by deformation, and then these sections are welded together at the position of the dowel. One disadvantage of this closing method is that it requires a large number of operating steps, making the speed of this known closing method and device (measured in number of closures per minute) relatively low, for example a processing speed of 15–20 closures per minute. In particular, it takes a relatively long time to bend the limb parts in order to realize the hook connection and the device's bending means need to be positioned accurately.

The same is true with respect to producing the dowel. The bending also causes an internal stress which the connection to be formed between the limb parts has to absorb. Said connection therefore has to be stronger than is strictly necessary for sealing. In addition, bending causes the planar characteristic of the closure to be lost, which may be disadvantageous during subsequent handling, including packing in large containers, transportation, placing on shop shelves etc., and may even cause damage to the flexible packaging. U.S. Pat. No. 5,286,110 discloses a tamper-proof seal in which a plastic ring is placed around the limb parts of the closure, which have been provided with a recess on a side edge, said ring being made to shrink into the recess so that the closure cannot be removed without destroying said ring. In this case, no connection is realized between the limb parts and the ring, but rather the shrunk ring is mechanically locked inside the recess. This is a laborious method as well, which is relatively time–consuming and therefore less suitable to be carried out by machine. In addition, the positioning of the ring relative to the limb parts has to be carried out accurately.

There is thus still a need in the field for alternatives for the tamper-proof fitting of closures. More particularly, there is a need for quick methods and devices.

The aim of the present invention is to fulfil one or more of the above needs completely or at least partially.

SUMMARY OF THE INVENTION

To this end, according to a first aspect, the invention relates to a method of the kind mentioned in the introductory part, the method comprising a subsequent step in which the slot is at least partially sealed by means of a seal which connects the limb parts to one another without substantially deforming the closure. Within the meaning of the present invention, a seal of the slot in the closure is a seal which has to be broken or removed visibly in order to remove the closure from the flexible packaging. A closure of this kind is also known as a tamper-evident closure, that is to say a closure which makes it possible to detect whether it has been opened. With the method according to the invention, a fixed connection is realized between the limb parts, in particular with an adhesive or an adhesive object, as will be explained below in more detail, so that a mechanical locking can be dispensed with. In addition, the closure, in particular the limb parts thereof, is not bent in relation to the main plane of the planar closure during closing. Using these measures, the method can be carried out very quickly, it being possible to achieve a speed of more than 100 closures per minute. By sealing the slot after the packaging has been introduced into the closure, it is possible to ascertain with great certainty whether the packaging has or has not been opened subsequent to a first closure, and thus whether the contents may have been altered or damaged.

In one preferred embodiment of the method according to the invention, the slot is sealed in the subsequent step by the limb parts of the closure adjacent to the slot being stuck together at least partially. A method of this kind can easily be carried out, for example by applying a quick–setting flowable adhesive, for example a thermoplastic, on and/or in the slot. The adhesive thus acts as a filler for the slot which simultaneously adheres to the closure. The amount of adhesive which is required with this method is small. Because of the small amount, the heat content is small and the adhesive sets immediately when it comes into contact with the relatively cold closure. Therefore, in a further preferred embodiment of the method according to the invention, a flowable adhesive is brought into contact with the limb parts during the subsequent step and forms the seal once it has set. The adhesive can be made flowable, for example, by heating it to above its flow or melting point.

In a most preferred embodiment, at least one limb part of the closure adjacent to the slot is provided with solid adhesive material, which is made to flow into the slot during the subsequent step and, once set, forms the seal. In this embodiment, the closure is provided with adhesive beforehand. After the closure has been arranged around an access side, such as the twisted neck of a bag as flexible packaging, only said adhesive has to be heated to a temperature above the flow point or melting point thereof so that it flows into the slot and sets to form a bridge connecting the limb parts of the closure to one another. Local heating of this kind can readily be achieved (on one or both main surfaces of the closure) by means of a hot needle, for example a pen or pin with internal (resistance) heating. As another method of heating, use can be made of ultrasound energy. The main advantage of this embodiment is that only one operation has to be carried out after the closure has been arranged around the flexible packaging, which means that the method can be carried out very quickly. In addition, with this embodiment, there is no risk of adhesive ending up in or on the flexible packaging. By contrast, this risk is present in the above mentioned embodiment and is undesirable in the packaging industry relating to foodstuffs and drugs.

In yet a further preferred embodiment, the adhesive is of a color which is different from that of the closure, particularly a color that contrasts strongly with white, such as red, green or black, as the color of the closure is generally white. This makes it easier to detect whether the respective packaging is still unopened or has already been opened. Furthermore, it is easier to direct the attention of a user, such as a consumer, to a seal of this kind.

In order to prevent the closure from being deformed when the adhesive is being heated, the adhesive advantageously has a lower flow temperature than the material from which the closure is made.

In another preferred embodiment of the method according to the invention, the slot is sealed by applying a solid adhesive object on at least part of the slot and on part of the closure surrounding the slot. An adhesive object of this kind may be an optionally printed sticker or the like, which adheres very strongly to the closure in such a manner that it cannot be removed and placed back on the closure without leaving traces. For example, an adhesive object, such as a strip of adhesive tape, is applied in such a manner that it adheres to both the top and bottom sides of the closure by folding the object over along the circumference of the closure adjacent to the slot. This embodiment of the method according to the invention can likewise be carried out quickly. In this case, the visual inspection of a seal can also easily be carried out, if the adhesive object has a colorwhich is different from the colorof the closure.

It should be emphasized that in the description of the present application, a distinction is made between an adhesive and an adhesive object.

Preferably, the seal in the method according to the invention is less strong than the planar closure. If such a seal is broken when the closure is opened, the crack will mainly be restricted to the area of the original slot. In other words, the seal forms a preferred breaking area. The function of the prior art slot as an opening through which the neck of the flexible packaging is guided can thus be re–used when it is closed again. Advantageously, the seal is of such a shape that it comprises a preferential breaking area at the position of the connection of the seal to the two circumferential parts of the closure on both sides of the slot. The seal can thus be broken away and a completely accessible, clear slot is produced.

More preferably, in the method according to the invention, the slot of the closure extends over a distance between the opening and the circumference of the closure which is larger than is customary with planar closures. This can be achieved by, for example, providing the opening of the closure in another position in the plane to that used until now, preferably by providing the opening in the centre of the surface of the closure, as the positioning of the opening partly determines the length of the slot. If the length of the slot is larger than usual, the parts of the closure delimiting the slot provide a larger surface on which to arrange a seal. The length of the slot which is customary in the field is between 4.0 and 4.5 mm, measured from the circumference of the closure up to the opening. This length applies to closures forming part of a strip of closures, where the slot extends towards the side of the strip (i.e. transverse to the longitudinal direction of the strip). Therefore, the slot length, as defined above, advantageously is 5 mm or more with closures according to the invention. For the sake of completeness, it should be mentioned that the slot does not have to be of a constant width over its entire length; generally, the slot is wider adjacent to the circumference of the closure compared to the part of the slot adjacent to the opening.

Advantageously, the closure is constructed in such a manner that it is treated in the area of the slot prior to sealing. If a heat treatment is used for sealing, the part of the closure that is being melted is advantageously designed to be thicker (for example as a result of the prior application of adhesive) and/or provided with a marking. If an adhesive object is used for sealing, the closure is, for example, provided with a marking or a recess for applying the adhesive object. In this case, the surface to which the adhesive object is applied is preferably designed in such a manner that it further increases the adhesion between the closure and the adhesive object. If sealing is effected by sticking, where an adhesive layer is applied to the parts on both sides of the slot, those parts may be provided with a recess so that the adhesive does not flow outside the recessed area.

According to a second aspect, the invention also relates to a method for producing a strip of interlinked planar closures, each comprising a receiving opening for receiving and retaining the access side of a flexible packaging, as well as a slot delimited by limb parts of the closure and extending between the circumference of the closure and the receiving opening, and coupling parts for coupling to a neighbouring closure, which method comprises a shaping step for shaping the closure by removing material from a strip of plastic material, the method comprising a preparation step, before the shaping step, of applying adhesive to a position where said slot will be provided during the shaping step. With said method according to the invention for producing a strip of closures, which is used in the most preferred closing method illustrated above, first adhesive is applied to the position where the slot will be made or to a limited part thereof, following which the strip is given its shape of interlinked closures by removal of material, for example by punching. By this removal, the access slot, receiving openings, the circumference and coupling parts are formed. In this shaping step, the adhesive which had been applied at the position of the slot is therefore also removed partly, but there remains enough on the limb parts to form a functional seal during closing.

Advantageously, during the preparation step, a hole is punched in the strip, at the position of the slot and limb parts to be formed, and the hole is filled with adhesive. This leads to a stronger adhesion of the adhesive with a view to the shaping step and subsequent use during closing.

The preferred embodiments with regard to color and flow temperature of the adhesive, as discussed above, apply to the production in a similar way.

According to a third aspect, the invention relates to a strip of interlinked planar closures made of plastic, each closure comprising an opening for receiving and retaining the access side of a flexible packaging, as well as a slot delimited by limb parts and extending between the circumference of the closure and the receiving opening, and coupling parts for coupling to a neighbouring closure, at least one limb part of the closure adjacent to the slot being provided with adhesive. A strip of this kind exhibits the above mentioned advantages when used in the closing method. The preferred embodiments with respect to color and flow temperature of the adhesive, as discussed above, apply to this strip in a similar way.

A fourth aspect of the invention relates to a device for closing an access side of a flexible packaging using a planar closure made of plastic, the closure comprising a receiving opening for receiving and retaining the access side of the flexible packaging, as well as a slot extending between the circumference of the closure and the receiving opening, the device comprising a conveying element for introducing the access side of the flexible packaging into the receiving opening of the closure and a sealing element for at least partially sealing the slot of the closure by means of a seal, in such a way that the limb parts are connected to each other without the latter being deformed. A device of this kind is characterized by the great speed that can thereby be achieved in the closing of flexible packaging. With such a device, the closure of the packaging is immediately followed by the sealing thereof, so that it is essentially impossible that packagings are opened without leaving visible traces. Furthermore, the above mentioned general advantages of packagings closed in this way apply.

In a first preferred embodiment of the device according to the invention, the sealing element comprises a heat source. Thus, a device is provided which, in combination with the closing of packagings, also seals the slot of the closure by a heat treatment of, for example, adhesive which is present on the closure or of the material of the closure itself.

In a second preferred embodiment of the device according to the invention, the sealing element comprises a dispensing unit for adhesive objects and a pressing means. The pressing means serves to press the adhesive objects onto the closure, while the dispensing unit positions the adhesive objects at the slot. In this manner, a device is provided which, in combination with the closing of packagings, also seals the slot of the closure by applying an adhesive object thereon.

In a third preferred embodiment of the device according to the invention, the sealing element comprises a metering unit for dispensing a flowable adhesive.

Preferably, the device according to the invention comprises a sealing element which is movably connected to the device by means of an arm. It is advantageous, when mechanically feeding in packagings which are provided with closures and subsequently removing the closed packagings, if the sealing elements are arranged to be movable in such a manner that they can move out of the path of conveyance of the packagings. At the time of sealing, the sealing element will as a matter of course be located inside the path of conveyance, which is not required or may even be undesirable at other times during the process.

According to a fifth aspect, the invention relates to a flexible packaging with contents, an access side of which is surrounded by a planar closure made of plastic, the closure comprising a receiving opening for receiving and retaining the access side of the flexible packaging, as well as a slot extending between the circumference of the closure and the receiving opening, at least part of the slot of the closure comprising a seal, more particularly a seal which comprises an adhesive connection which extends between limb parts of the closure on both sides of the slot. A packaging of this kind offers the advantages already mentioned above, which make it easier to see whether a closure has previously been opened. From the point of view of assuring the quality of the packaged product, such a packaging is thus desirable.

In a preferred embodiment, the closure seal of the flexible packaging according to the invention comprises an adhesive object which is applied to at least a part of the slot and a part of the closure on both sides of the slot. A seal of this kind is clearly visible and can therefore be inspected for improper use once the closure has been applied to the packaging. This advantage applies even more when the color of the adhesive object is different from that of the closure. The following preferred embodiments of the closure seal of the flexible packaging according to the invention are likewise advantageous for reasons which have already been mentioned above.

According to one of the most preferred embodiments, the closure seal of the flexible packaging according to the invention comprises adhesive which extends between parts of the closure on both sides of the slot.

According to another preferred embodiment, the seal comprises material from which the closure is made and which extends between parts of the closure on both sides of the slot. According to a further preferred embodiment, the seal is less strong than the planar closure, for example less thick.

A further preferred embodiment relates to a flexible packaging closed with a closure according to the invention, in which the opening is provided in the centre of the closure. Thus, the slot of the closure is of a greater length than the usual length of 4.5 mm. The associated advantages with respect to sealing have already been mentioned above.

According to a sixth aspect, the invention relates to a planar closure made of plastic, comprising a receiving opening for receiving and retaining the access side of the flexible packaging, a slot extending between the circumference of the closure and the receiving opening, and a groove which is provided in the surface of the closure and extends between the receiving opening of the closure and the outer edge of the closure, it being possible to break the groove open to form a second slot. The advantage of such a closure is that the seal of the slot can be permanent in nature and does not have to be broken open by the consumer, since the groove can be used for this purpose.

The invention also relates to a strip of interlinked planar closures of the kind according to the sixth aspect of the invention, the closures being linked to one another by coupling parts.

BREIF DESCRIPTION OF THE DRAWINGS

The invention will be explained below with reference to the accompanying drawings, in which.

DETAILED DESCRIPTION OF THE PREFERRED EMBODIMENTS

Figure 1:
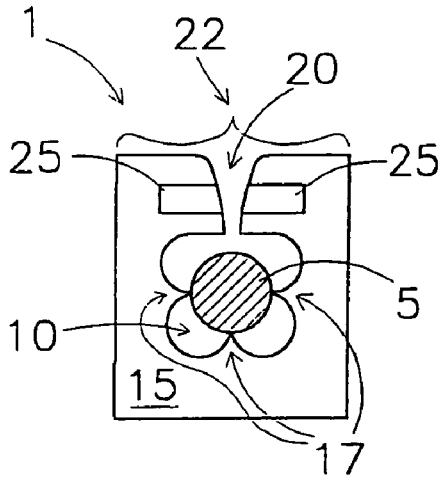
FIG. 1 shows a plan view of a neck of a flexible packaging, which is provided with a planar closure according to the invention.

FIG. 1 shows the entity 1 consisting of a neck 5 of a flexible packaging which has been introduced into an opening 10 of a planar closure 15 made of plastic. The part of the closure 15 which delimits the opening 10 is provided with projecting parts 17 in order to enable the closure to engage on the neck 5, so that a fixed position of the closure 15 with respect to the neck 5 is ensured. Furthermore, the closure 15 comprises a slot 20 which extends from the inlet side 22 of the closure 15 to the opening 10. The slot 20 gradually widens in the direction of the inlet side 22, so that the introduction of the neck 5 into the slot 20 is facilitated. Parts 25 of the closure 15 which adjoin the slot 20 on both sides, have been treated prior to sealing of the slot 20. In this embodiment, these parts 25 have a visually distinguishable surface.

Figure 2:
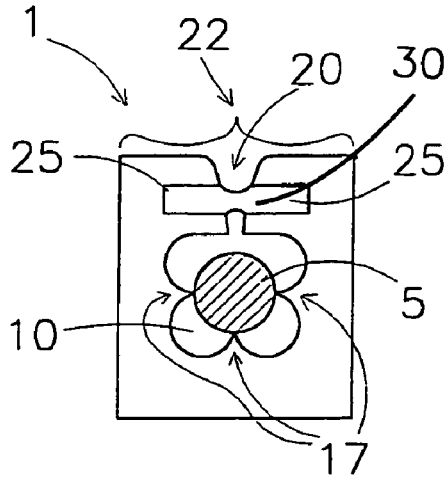
FIG. 2 shows a plan view of the same flexible packaging as in FIG. 1, after the planar closure has been sealed by a heat treatment in accordance with an embodiment of the method of the invention.

FIG. 2 shows the entity 1 from FIG. 1 after a heat treatment has been carried out on part 25, leading to a seal 30 resulting from the melting together of the part 25 from both sides of the closure 15 delimiting the slot 20. The seal 30 is thinner than the remaining part of the closure 15, as a result of which the seal 30 has a lower breaking strength than the closure 15 itself.

Figure 3:
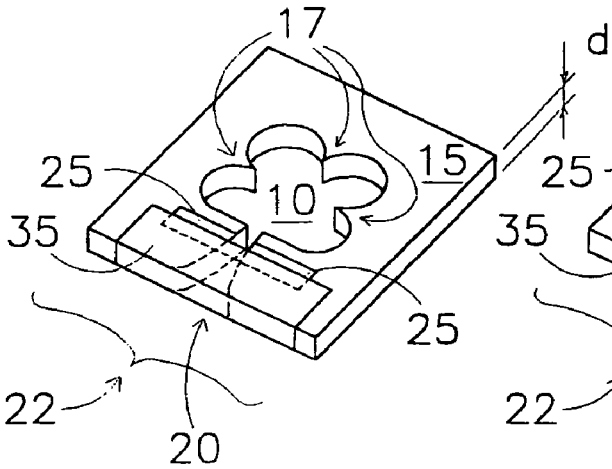
FIG. 3 shows a perspective view of a planar closure according to the invention, which is sealed with an adhesive object (for the sake of clarity, the neck of the object which the closure seals has been omitted)

FIG. 3 shows a perspective view of a planar closure 15, after an adhesive object 35 has been applied to the part 25 to seal the slot 20. The adhesive object 35 is a sticker which may exhibit an increased adhesion to the part 25 if the latter, for example, has a rough surface. As the figure shows, the sticker is folded over the inlet side 22 of the closure 15, so that it adheres to the top and bottom sides of the closure 15. The figure also shows that the thickness d of the closure 15 is a fraction of the width and length of the closure 15. The neck 5 of the flexible packaging, as shown in FIGS. 1 and 2 inside the opening 10, has been omitted from this figure for reasons of clarity.

Figure 4:
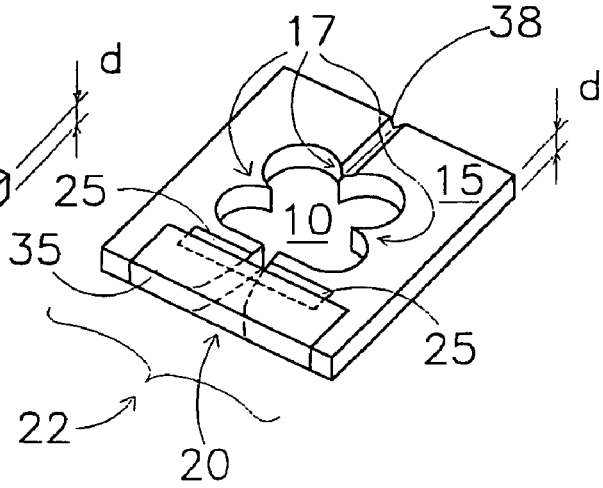
FIG. 4 shows an identical view to that of FIG. 3, in which the planar closure according to a preferred embodiment is provided with a groove which can be broken open to form a second slot.

FIG. 4 shows the same view as FIG. 3, with the planar closure 15 being provided with a groove 38 which can be broken open to form a second slot. The groove 38 has been provided on the side opposite to the slot 20 and extends in a straight line from the opening 10 up to the respective outer edge of the planar closure 15. The groove 38 forms a uniform recess in the upper surface of the planar closure 15. A groove of this kind may also be provided on the top and bottom sides.

Figure 5:
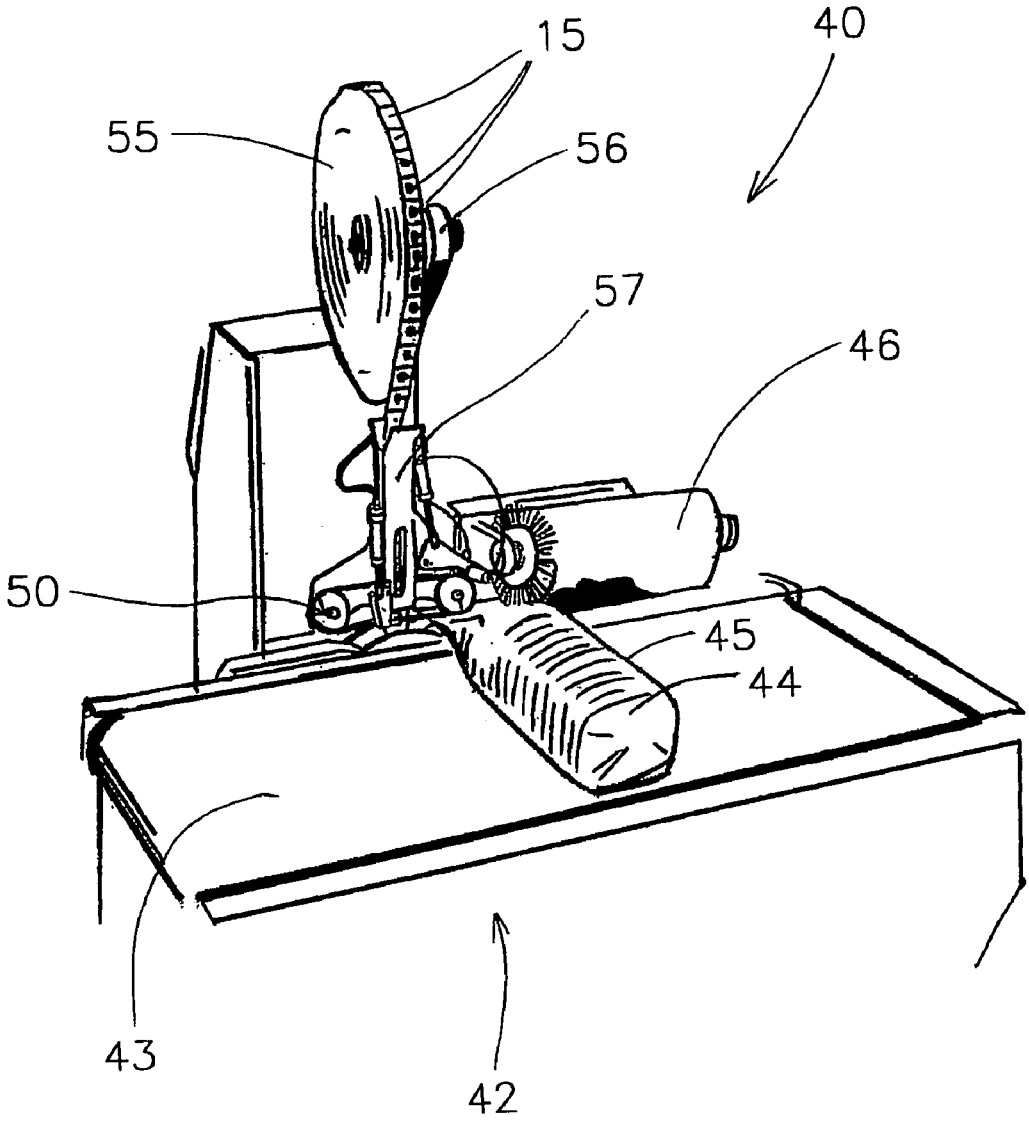
FIGS. 5–11 show two preferred embodiments of the device according to the invention, in different stages of the method according to the invention.

FIG. 5 shows an overview of a device 40 according to a preferred embodiment of the invention, which is used in the method according to the invention. The device 40 comprises a frame 42 over which loaves of bread 44 are conveyed by means of a conveyor belt 43, which loaves have been placed inside a flexible packaging 45. The flexible packaging is flattened at its open end by brushes 46. At the open end, the flexible packaging is also guided through a conveyor 50 and compressed further to form a neck shape. A coiled strip 55 consisting of interconnected closures 15 and suspended from a shaft 56 is provided above the frame 42. Closures 15 are fed from the strip 55 through the guide 57 in such a manner that one closure 15 is supplied per supplied packaging 45.

Figure 6:
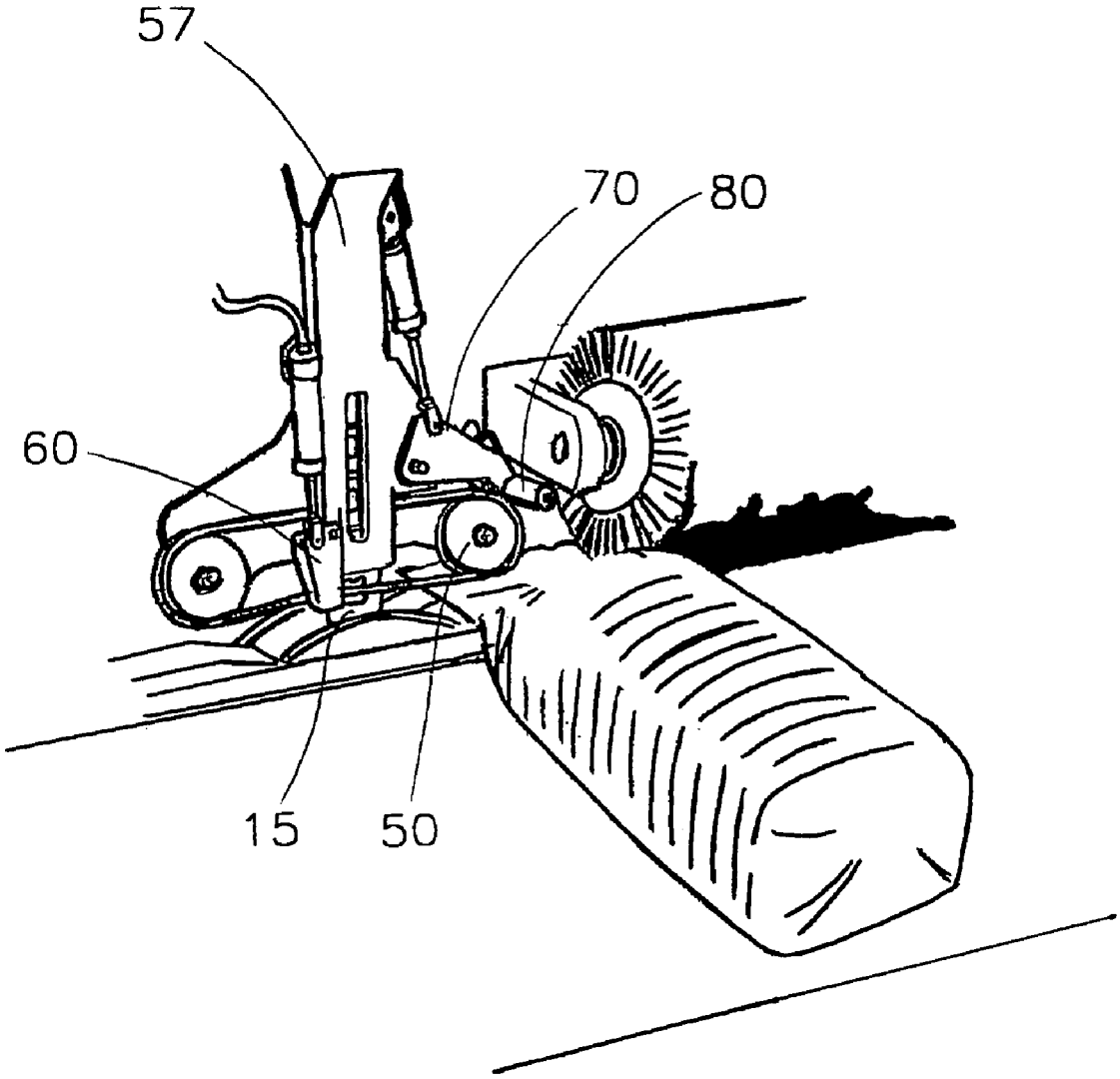

FIG. 6 shows a detail from FIG. 5, in which a positioned closure 15 is retained on one side by a movable retaining means 60, while the open end of the bread bag is supplied by the conveyor 50 at the inlet side 22 of the closure 15. The retaining means 60 is mounted on the guide 57. In addition, a movable arm 70 is mounted on the guide 57, said arm being provided with a sealing element 80.

Figure 7:
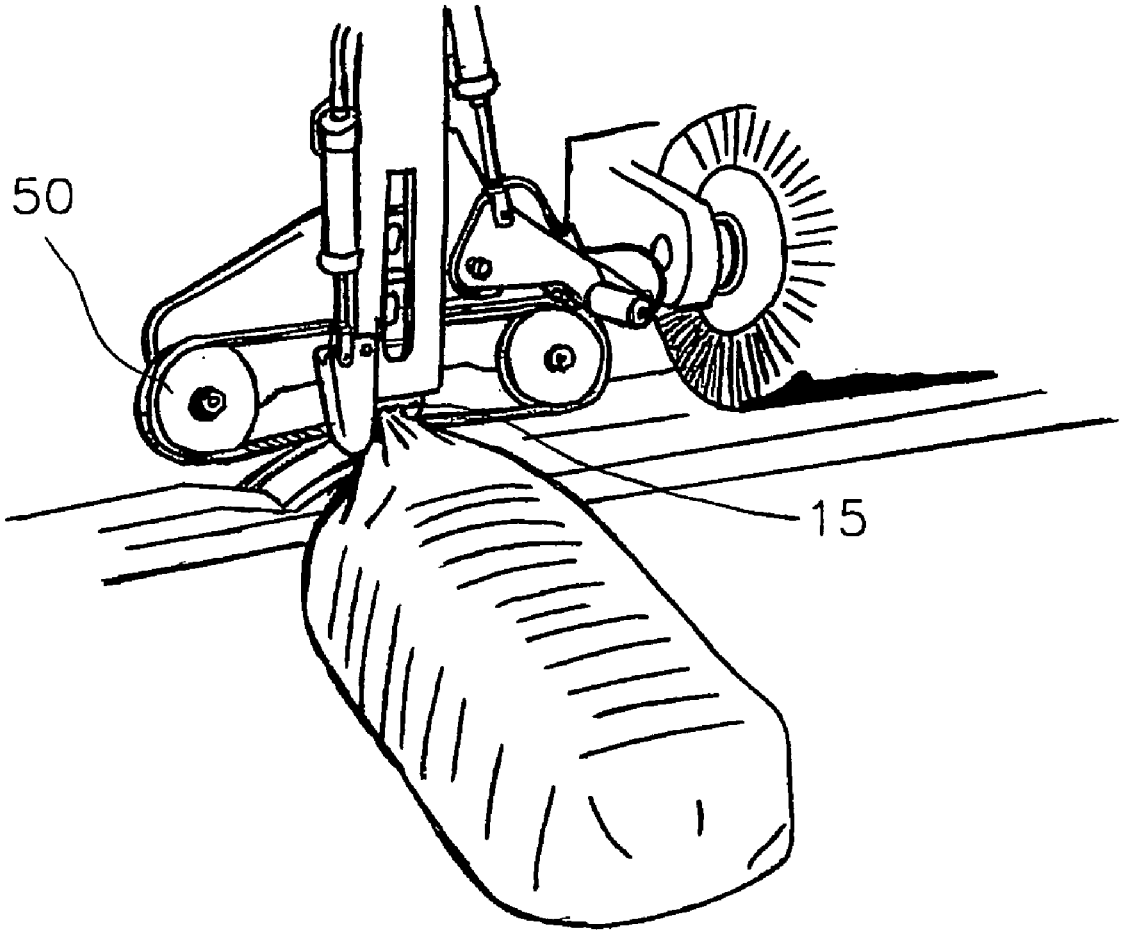

FIG. 7 shows a similar view to that of FIG. 6, which illustrates the subsequent step of introducing the neck of the bread bag into the closure 15 as a result of the movement of the conveyor 50, leading to the open end being compressed to form a neck shape.

Figure 8:
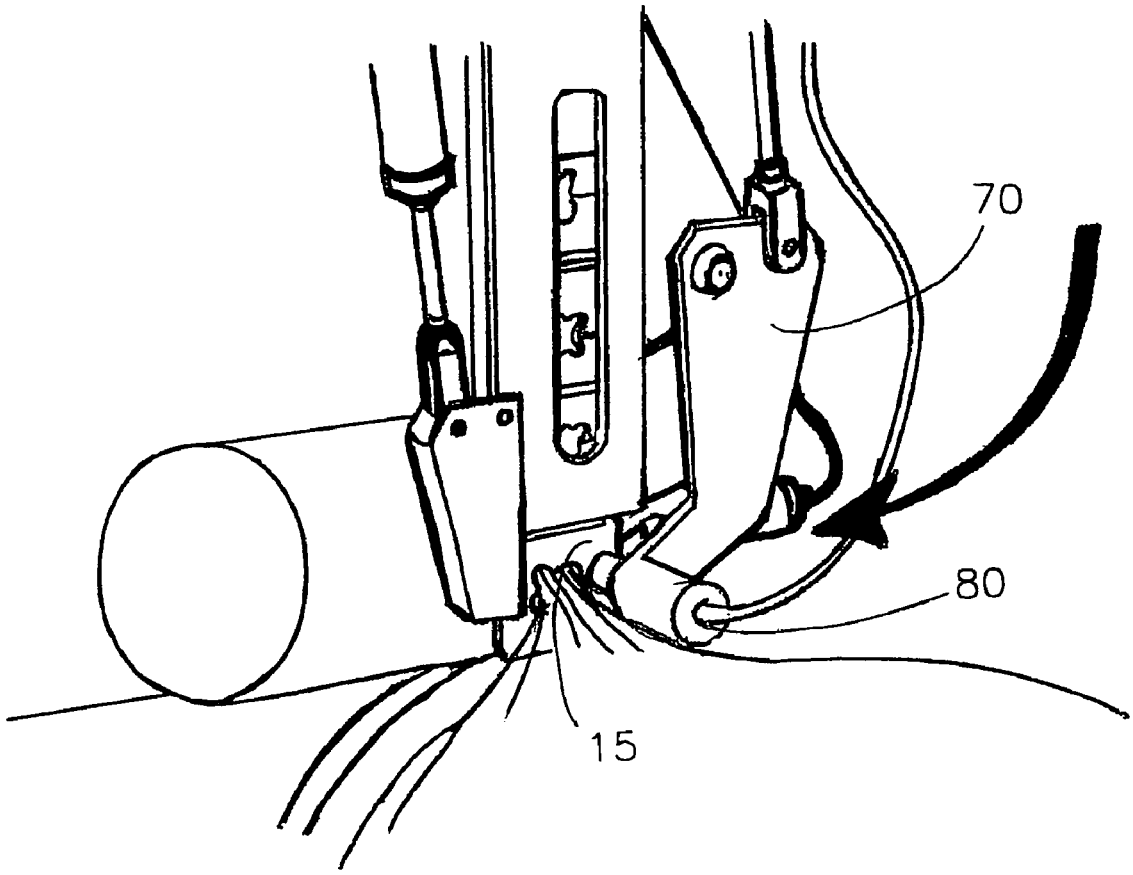

FIG. 8 shows a view similar to those of FIGS. 6 and 7, which illustrates the subsequent step of sealing the closure 15 at the position of the slot by moving the arm 70 downwards in rotating fashion (indicated by the large arrow), as a result of which the sealing element 80 is positioned correctly. The sealing element 80 is a heat source which melts the material at the position of the slot, resulting in a sealed closure 15.

Figure 9:
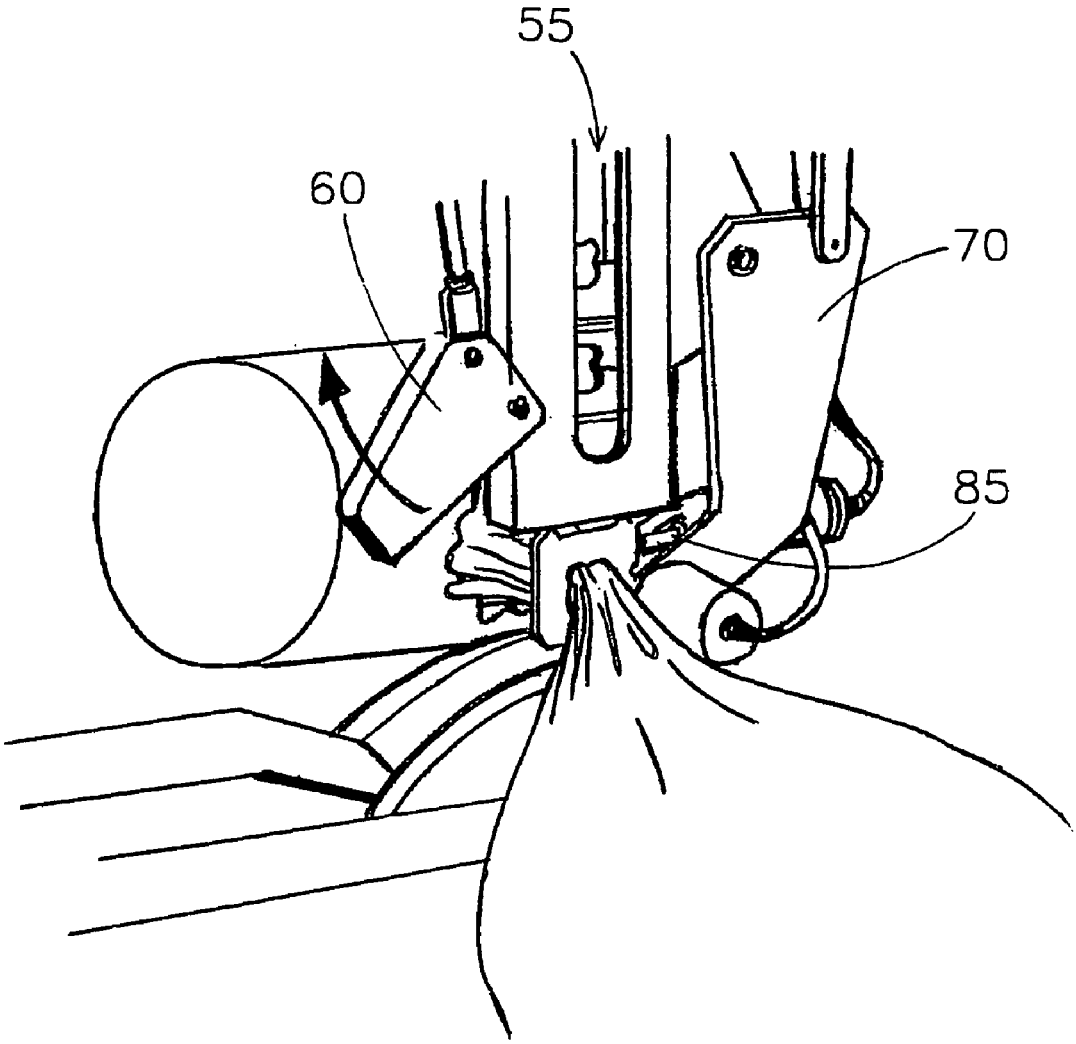

FIG. 9 shows a view similar to those of FIGS. 6–8, which illustrates the subsequent step of moving the retaining means 60 upwards (indicated by the arrow), after which an ejector 85, which is fitted on the arm 70, breaks off the positioned closure 15 from the strip 55 and the arm 70 then moves upwards again (these actions have not been represented). The bread bag is subsequently transported away, comprising a closure 15 sealed by melting.

Figure 10:
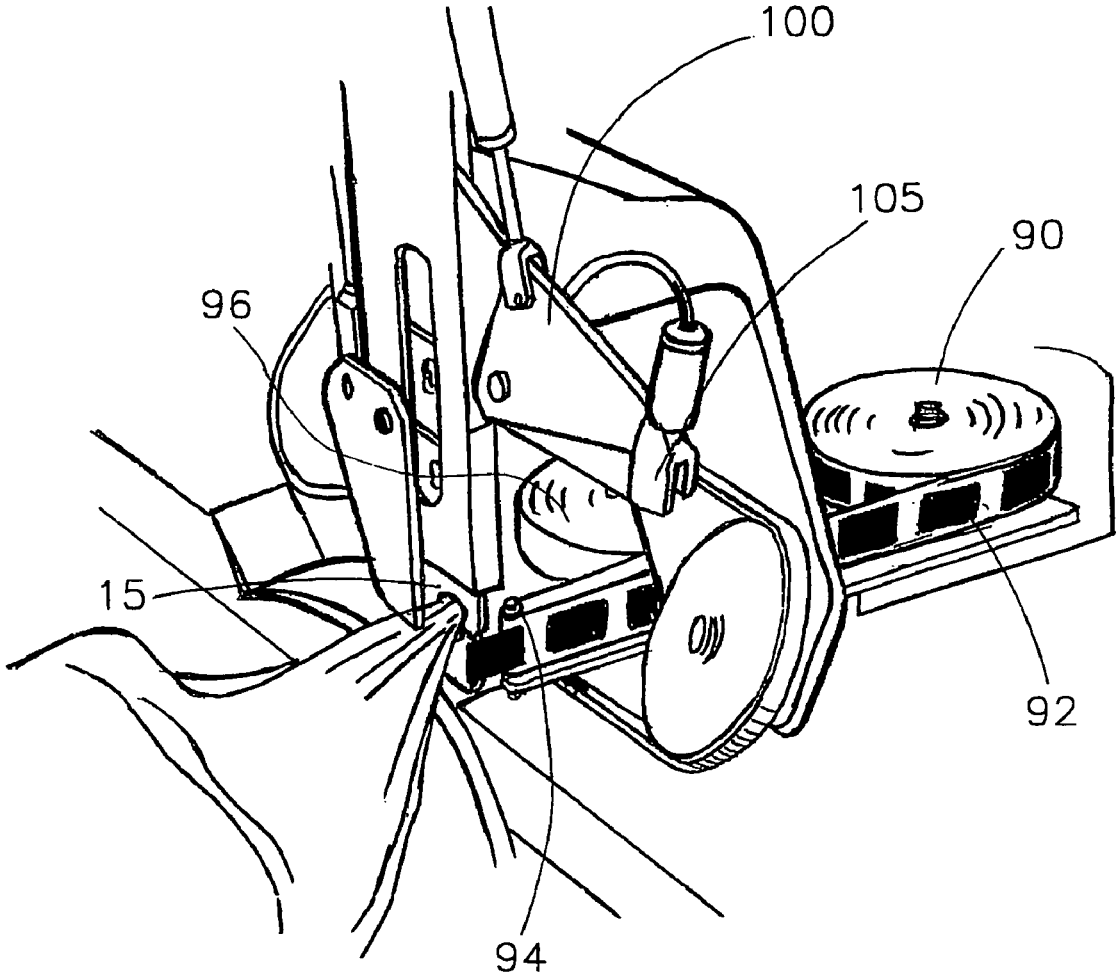
Figure 11:
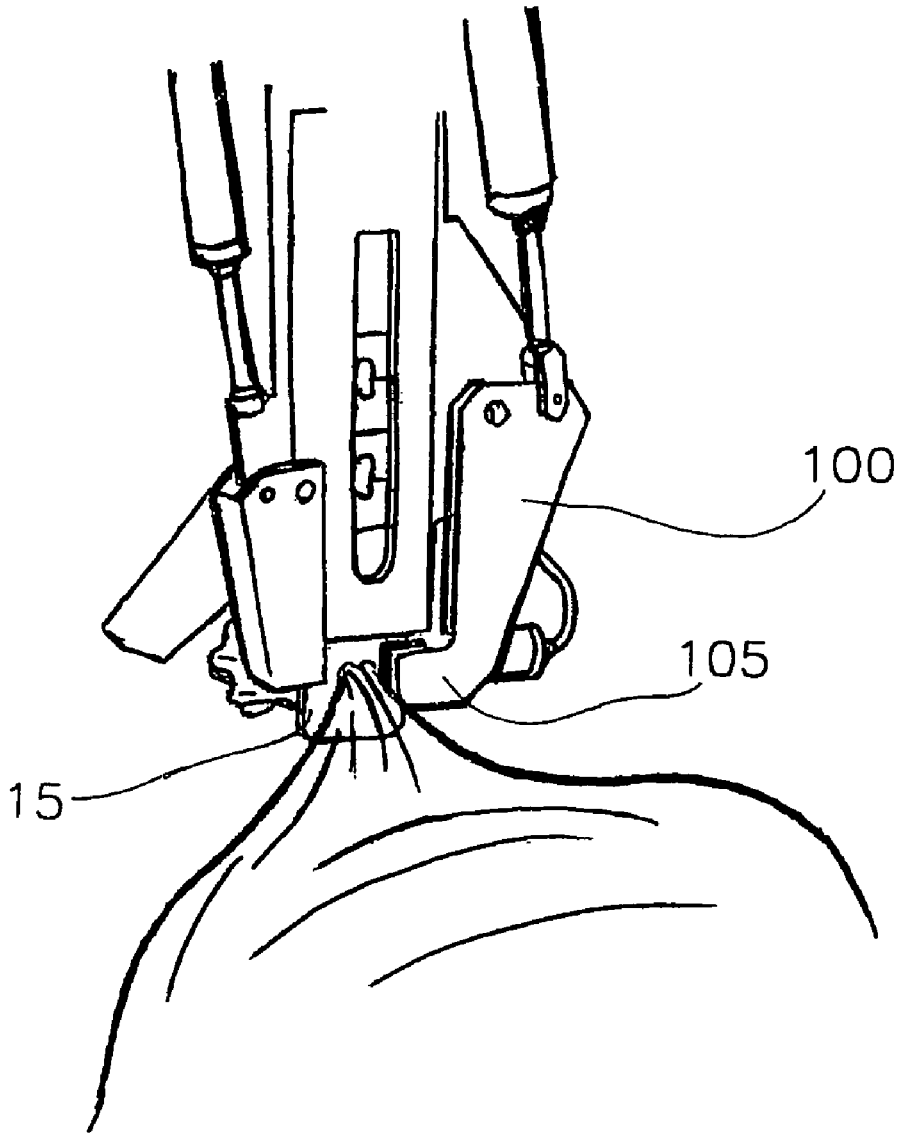

FIG. 10 shows a side view of another preferred embodiment of the device according to the invention, in which the closure is sealed in a different manner. To this end, the device is provided with a strip 90 containing stickers 92, which strip 90 is moved past a return end 94 and subsequently rolled up to form a roll 96. As can be seen in FIG. 10, one sticker 92 is partly unrolled at the return end 94 before the inlet side of the closure 15 at the position of the positioned closure into which the neck of a bread bag has been introduced. The illustrated arm 100 with pressing means 105 then moves to the inlet side, in order to press the sticker onto the front and back side of the closure 15, as is illustrated in FIG. 11. The bread bag is then transported away, comprising a closure sealed by a sticker 92.

Figure 12:
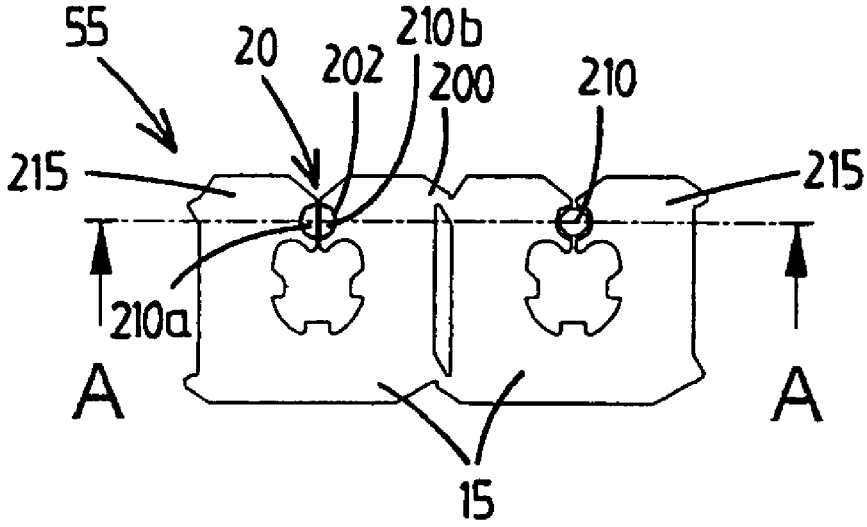
FIGS. 12 and 13 show a preferred embodiment of a section of a strip of interlinked closures according to the invention.
Figure 13:
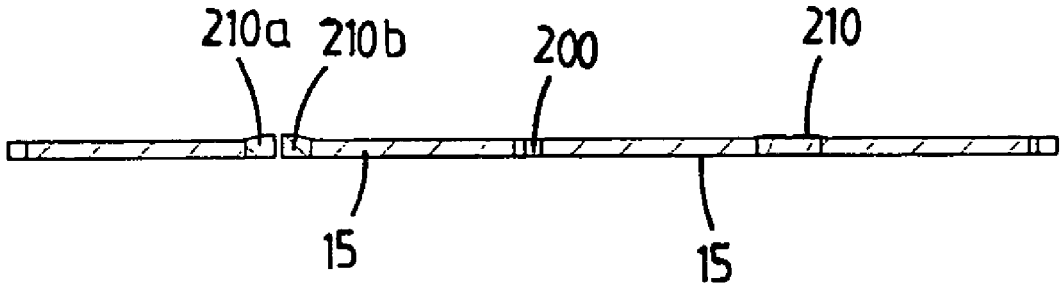

FIG. 12 shows a strip 55 of closures 15, which are connected to one another by coupling parts 200. At a position near the slot 20, a hole 202 was made in the original strip of material during the production and filled with adhesive 210, following which the strip of material has been subjected to a punching operation in order to form it into a strip 55 of interlinked closures 15. During this punching operation, the slot 20 has also been formed in the adhesive 210 with which the hole 202 was filled (only represented in the left-hand closure), so that, in the finished strip 55, there are adhesive sections 210*a* and 210*b*, respectively, in both limb parts 215, which, as is illustrated by the cross section according to FIG. 13 shown on an enlarged scale, project out of the upper surface of a closure 15. The adhesive 210 is of a color which contrasts strongly with the color of the closure, for example green.

The invention claimed is:

1. Method of closing an access side of a flexible packaging using a planar closure made of plastic, the closure comprising a receiving opening for receiving and retaining the access side of the flexible packaging, as well as a slot delimited by limb parts of the closure and extending between the circumference of the closure and the receiving opening, said method comprising the step of introducing the access side of the flexible packaging into the receiving opening of the closure, and a subsequent step wherein the slot is at least partially sealed by means of a seal which connects the limb parts to one another without substantially deforming the closure and the seal.

2. Method according to claim 1, in which the slot is sealed by the limb parts of the closure being stuck together.

3. Method according to claim 2, in which, during the subsequent step, flowable adhesive is applied to the limb parts and forms the seal once it has set.

4. Method according to claim 2, in which at least one limb part of the closure adjacent to the slot is provided with a solid adhesive, said solid adhesive is made to flow into the slot during the subsequent step and forms the seal once it has set.

5. Method according to claim 3 or 4, in which the adhesive is of a color which is different from that of the closure.

6. Method according to claim 3 or 4, in which the adhesive has a lower flow temperature than the material from which the closure is made.

7. Method according to claim 3 or 4, in which the subsequent step comprises supplying heat in order to make the adhesive flow.

8. Method according to claim 1, in which the slot is sealed by applying an adhesive object on at least part of the slot and on part of the closure surrounding the slot.

9. Method according to claim 1, in which the subsequent step is carried out in such a way that the resulting seal is less strong than the planar closure.

10. Method according to claim 1, in which the opening is provided in the centre of the surface of the closure.

11. Device for closing an access side of a flexible packaging using a planar closure made of plastic, the closure comprising a receiving opening for receiving and retaining the access side of the flexible packaging, as well as a slot extending between the circumference of the closure and the receiving opening, the device comprising a conveying element for introducing the access side of the flexible packaging into the receiving opening of the closure, the device comprising a sealing unit for at least partially sealing the slot of the closure by means of a seal, in such a manner that the limb parts are connected to one another without deforming the closure and the seal.

12. Device according to claim 11, in which the sealing unit comprises a heat source.

13. Device according to claim 11, in which the sealing unit comprises a dispensing unit for adhesive objects and a pressing means.

14. Device according to claim 11, in which the sealing unit comprises a metering unit for dispensing adhesive.

15. Device according to claim 11, in which the sealing unit is movably connected to the device by means of an arm.

* * * * *